US007556024B2

(12) United States Patent
Crary et al.

(10) Patent No.: US 7,556,024 B2
(45) Date of Patent: Jul. 7, 2009

(54) FUEL SUPPLY MODULE

(75) Inventors: Lynwood F. Crary, Preston, CT (US); Antonio J. DaSilva, Middletown, CT (US)

(73) Assignee: TI Group Automotive Systems, L.L.C., Warren, MI (US)

( * ) Notice: Subject to any disclaimer, the term of this patent is extended or adjusted under 35 U.S.C. 154(b) by 0 days.

(21) Appl. No.: 11/533,197

(22) Filed: Sep. 19, 2006

(65) Prior Publication Data

US 2007/0062493 A1 Mar. 22, 2007

Related U.S. Application Data

(60) Provisional application No. 60/719,622, filed on Sep. 22, 2005.

(51) Int. Cl.
*F02M 37/04* (2006.01)

(52) U.S. Cl. ..... 123/509; 123/495

(58) Field of Classification Search ..... 123/509, 123/495; 137/571; 210/121, 236
See application file for complete search history.

(56) References Cited

U.S. PATENT DOCUMENTS 3,561,660 A * 2/1971 Nicol et al. ..... 226/187
4,750,518 A * 6/1988 Griffin et al. ..... 137/565.17
4,807,582 A 2/1989 Tuckey
5,398,656 A 3/1995 Brisbane et al.
5,522,425 A 6/1996 Kroiss et al.
5,669,359 A * 9/1997 Kleppner et al. ..... 123/509
6,000,913 A 12/1999 Chung et al.
6,302,144 B1 10/2001 Graham et al.
6,308,733 B2 10/2001 Murakoshi et al.
6,436,287 B1 8/2002 Fischerkeller et al.
6,453,870 B1 * 9/2002 Koller et al. ..... 123/198 E
6,640,832 B2 * 11/2003 Walter ..... 137/565.01
6,716,000 B2 4/2004 Appleton et al.
6,941,808 B2 9/2005 Gouzou et al.
6,964,265 B2 * 11/2005 Iwamoto ..... 123/510
6,966,305 B2 11/2005 Aubree et al.

FOREIGN PATENT DOCUMENTS

FR 2771972 6/1999
WO WO 0225094 3/2005

* cited by examiner

*Primary Examiner*—Stephen K Cronin
*Assistant Examiner*—J. Page Hufty
(74) *Attorney, Agent, or Firm*—Reising Ethington P.C.

(57) ABSTRACT

A fuel supply module may include a reservoir and a fuel filter carried by the reservoir. In one implementation, the filter assembly may be pivoted relative to the reservoir when the fuel pump module is inserted through an access opening of the fuel tank. Thereafter, when the fuel pump module is mounted to the fuel tank, the filter assembly may pivot to a second position angularly displaced from the first position. In another implementation, the position of the filter assembly is fixed relative to the reservoir.

25 Claims, 7 Drawing Sheets

FUEL SUPPLY MODULE

REFERENCE TO COPENDING APPLICATION

This application claims the benefit of U.S. Provisional Patent Application Ser. No. 60/719,622, which was assigned a filing date of Sep. 22, 2005, the disclosure of which is incorporated by reference in its entirety.

FIELD OF THE INVENTION

The present invention relates generally to a fuel system and more particularly to a fuel supply module for a vehicle fuel system.

BACKGROUND OF THE INVENTION

Vehicles typically include a fuel system with a fuel tank, a fuel pump that pumps fuel from the tank to a vehicle engine to support operation of the engine, and various other components, such as a fuel level sensor, fuel pressure regulator, fuel injectors, fuel filter and the like. In some vehicles, the fuel pump is mounted within the vehicle fuel tank as part of a module or assembly that may include other components of the fuel system, such as the fuel level sensor and one or more fuel filters all carried on a common support structure. Some modules have been mounted in the fuel tank by a mounting flange received in an opening of a fuel tank and secured to a wall of the fuel tank. Often, in automobiles, the fuel tanks are disposed in relatively small oddly shaped areas which can lead to a wide range of shapes and sizes of fuel tanks. Some fuel tanks may have a limited depth or other constructions that make it difficult to insert a module that includes full size accessories or components into the fuel tank. In some applications, reducing the size of the components, for example a fuel reservoir in which the fuel pump is received, or a fuel filter, is not desirable since the performance of the fuel module may be diminished.

SUMMARY OF THE INVENTION

A fuel supply module includes a reservoir and a fuel filter carried by the reservoir. In one implementation, the filter assembly may be pivoted relative to the reservoir when the fuel pump module is inserted through an access opening of the fuel tank. Thereafter, when the fuel pump module is mounted to the fuel tank, the filter assembly may pivot to a second position angularly displaced from the first position. In another implementation, the position of the filter assembly is fixed relative to the reservoir.

At least some of the objects, features and advantages that at least some embodiments of the fuel pump assembly may provide include permitting maximum size fuel pump module components to be inserted into a fuel tank, permitting use of a lifetime fuel filter downstream of a fuel pump and carried by the module, facilitating design of the fuel pump module for use in even shallow fuel tanks, facilitate assembly of the fuel pump module into a fuel tank, is of relatively simple design and economical manufacture and assembly, and in service has a long, useful life.

BRIEF DESCRIPTION OF THE DRAWINGS

These and other objects, features and advantages of the present invention will be apparent from the following detailed description of the preferred embodiments and best mode, appended claims and accompanying drawings in which:

DETAILED DESCRIPTION OF PREFERRED EMBODIMENTS

Figure 1:
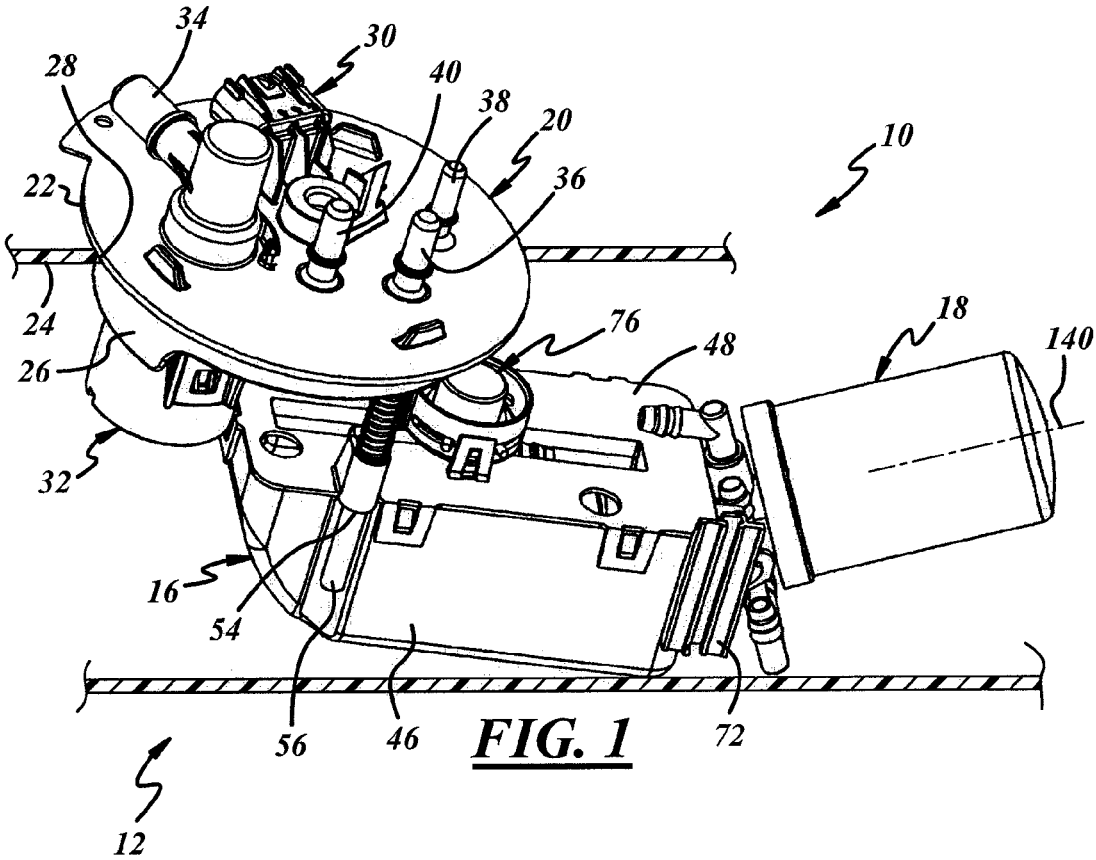
FIG. 1 is a perspective view of one embodiment of a fuel pump module.
Figure 2:
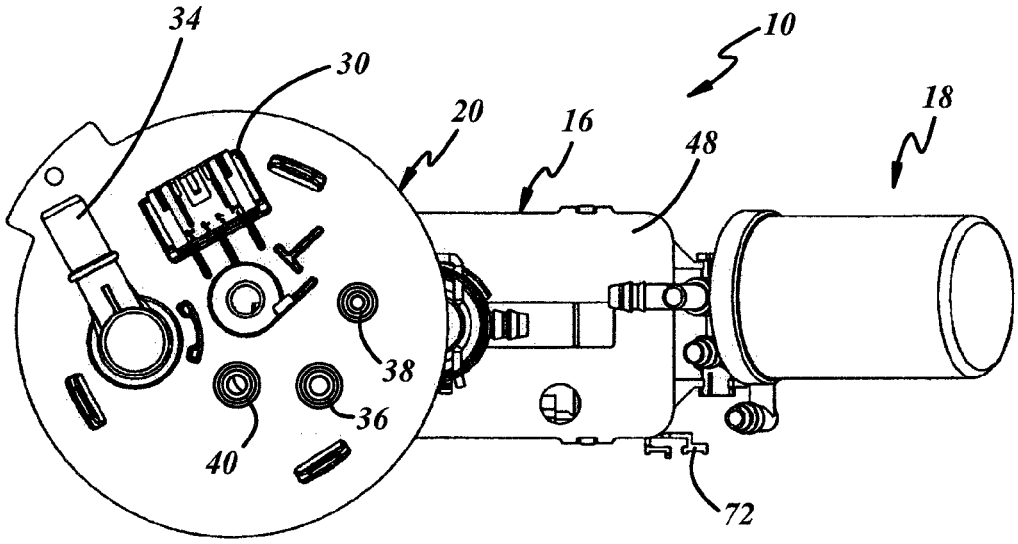
FIG. 2 is a top view of the fuel pump module.

Referring in more detail to the drawings, FIGS. 1-6 illustrate a fuel pump module 10 that is constructed and arranged to be disposed within a vehicle fuel tank 12. The module 10 includes an electric motor driven fuel pump 14 (FIG. 5) that delivers fuel under pressure from the fuel tank to an engine to support operation of the engine. The module 10 preferably also includes a reservoir 16 in which a supply of fuel and the fuel pump 14 are received. In one implementation, a fuel filter assembly 18 is mounted for pivoted movement relative to the reservoir 16 to facilitate insertion of the fuel pump module 10 into the fuel tank.

The fuel pump module 10 includes a mounting flange 20 having a radially outwardly extending lip 22 adapted to overlie and be sealed to a fuel tank wall 24, and a depending cylindrical skirt 26 adapted to be received within an opening 28 of the fuel tank. The mounting flange 20 may carry one or more components or accessories of the fuel pump module 10, such as an electric pass-through connector 30, and a fuel vapor vent valve 32 which includes a vent outlet fitting 34 that may communicate with a fuel vapor canister, or other device. The fuel vapor vent valve 32 and electrical connector 30 may be of generally standard construction and will not be described further herein. One or more fluid connector fittings may be provided on or molded with the mounting flange 20. One fitting 36 may communicate the outlet of the fuel pump 14 with a fuel line through which fuel is delivered to the engine. Another fitting 38 may communicate with a vent valve, if desired. And another fitting 40 may be used for any other fluid flow, or may be capped if its use is not needed or desired. The mounting flange 20 may be molded of a polymeric material suitable for use with a fuel tank, and to be sealed to a fuel tank wall. The mounting flange 20 may include one or more blind bores in cylindrical projections 42 open to the fuel tank.

The reservoir 16 may be formed in any suitable shape for a particular application. In the embodiment shown, the reservoir 16 includes a body 46 and a lid 48 snap fit by a plurality of snap latches 50 disposed over tabs 52 on the body 46 of the reservoir. The body 46 and lid 48 of the reservoir 16 define an interior 53 (FIGS. 5 and 10) in which liquid fuel and the fuel pump 14 are received. The fuel pump 14 may be of substantially any construction desired, and may include an electric motor which drives a pumping element to take in fuel from the reservoir volume and deliver fuel under pressure from an outlet, as discussed further herein. The reservoir 16 preferably includes one or more through bores 54 which preferably are outboard of and do not communicate with the reservoir interior and preferably are aligned with the blind bores 42 in the mounting flange 20. A rod 56 is disposed in each projections 42 of the mounting flange 20 and through the bores 54 in the reservoir 16 to interconnect the reservoir 16 and mounting flange 20. Springs 58 may be disposed about the rods 56 and between the reservoir 16 and mounting flange 20 to yieldably bias the reservoir away from the mounting flange, so that the reservoir 16 is yieldably disposed immediately adjacent to a lower surface of the fuel tank 12 when the module 10 is disposed within a fuel tank.

As best shown in FIGS. 3, 6, 10 and 11, at one end of the reservoir 16, a mounting bracket 62 is provided. The mounting bracket 62 may be formed partially or entirely separate from or integrally with the body 46, lid 48, or both, of the reservoir 16, if desired. In the embodiment shown, the lid 48 and body 46 of the reservoir may be formed of molded polymeric material suitable for use in liquid fuel. The bracket 62 preferably includes a pair of generally parallel, spaced apart trunnion mounts 64. The mounts 64 include a generally U-shaped finger having an open area 66 oriented upwardly, or in other words, in a direction away from a lower wall 68 of the reservoir 16 and generally toward the lid 48 in the illustrated embodiment and as viewed in FIG. 3. An inner surface 70 (FIG. 11) of each mount 64 preferably spans more than one-half of a circle so that the distance spanned by the open area 66 is less than the maximum diameter of the inner surface 70 of the mount 64. As best shown in FIGS. 1-3, 7 and 8, the reservoir 16 preferably also includes a bracket 72 to which a fuel level sensor 74 may be connected. The bracket 72 may be formed integral with the body 46, lid 48 or both of the reservoir 16, or may be separately carried thereby.

Figure 3:
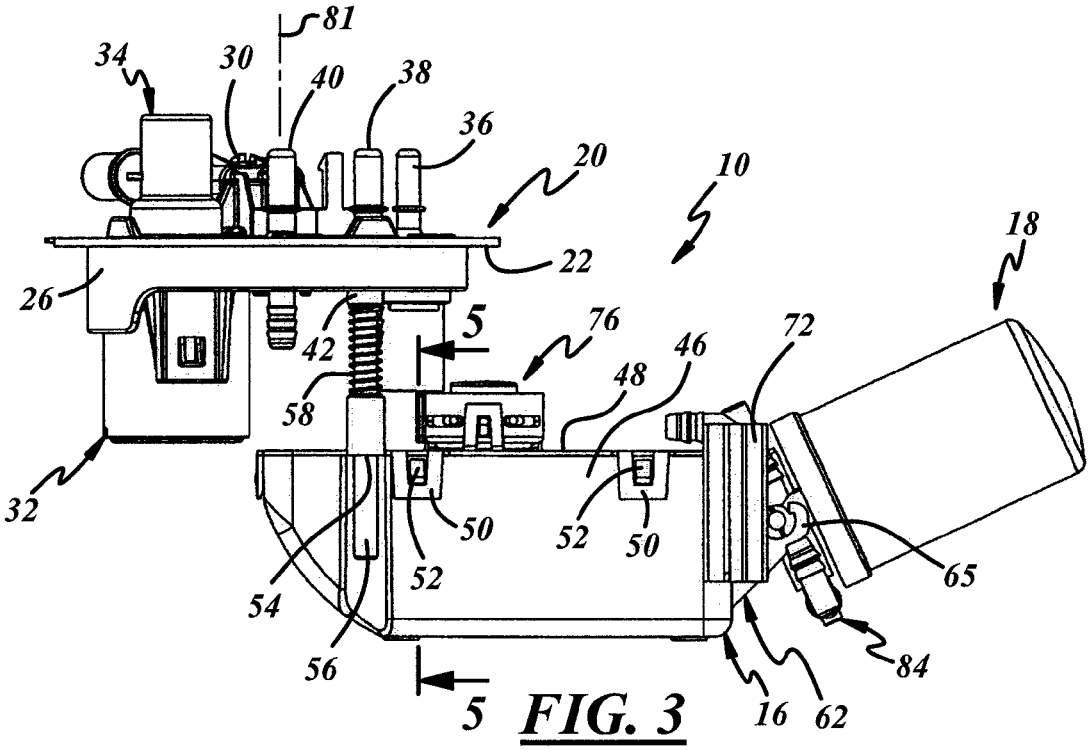
FIG. 3 is a front view of the fuel pump module.
Figure 6:
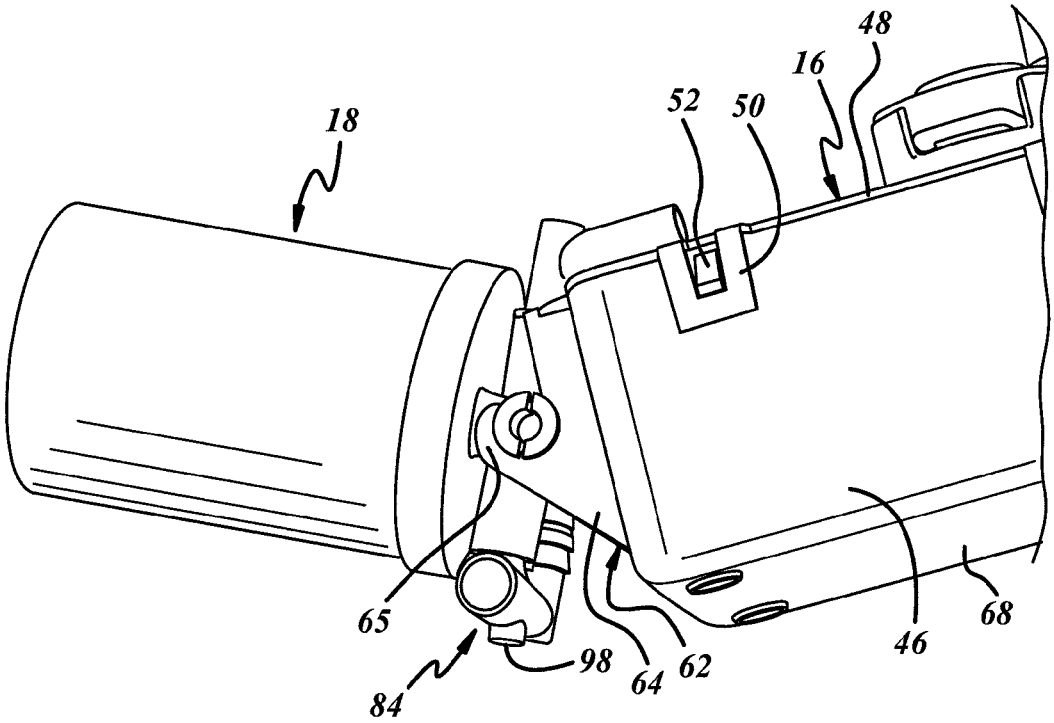
FIG. 6 is an enlarged fragmentary side view of a portion of the fuel pump module.
Figure 5:
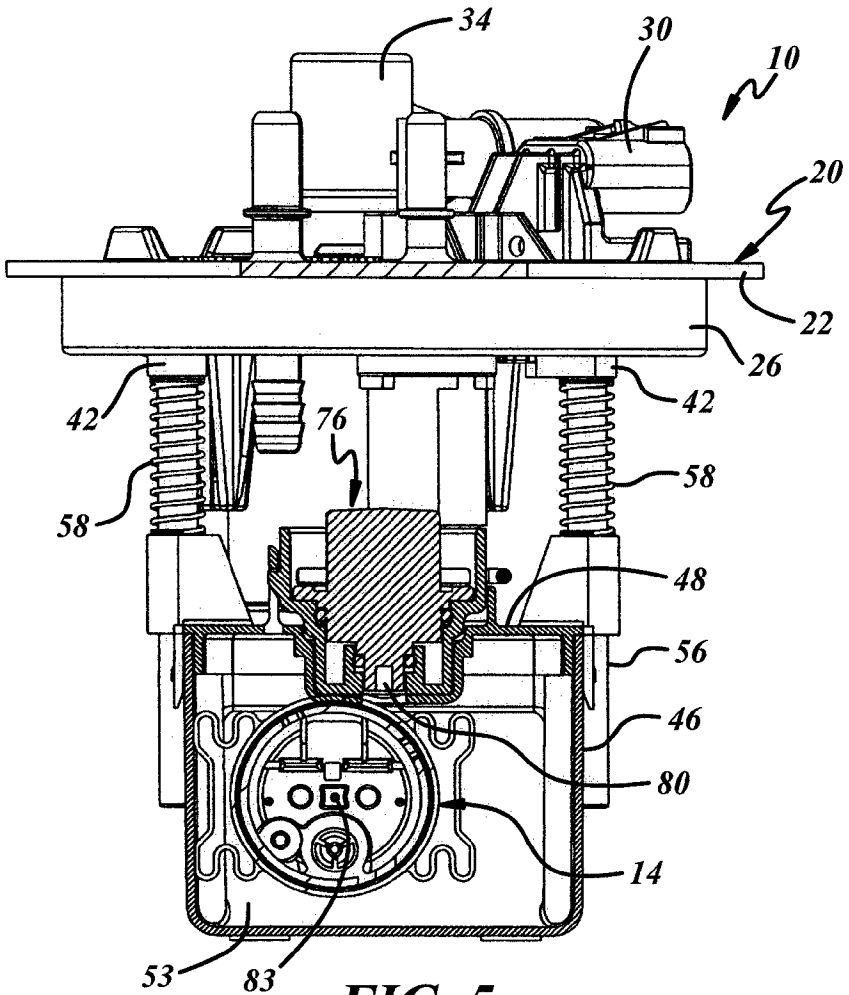
FIG. 5 is a sectional view taken generally along line 5-5 in FIG. 3.
Figure 4:
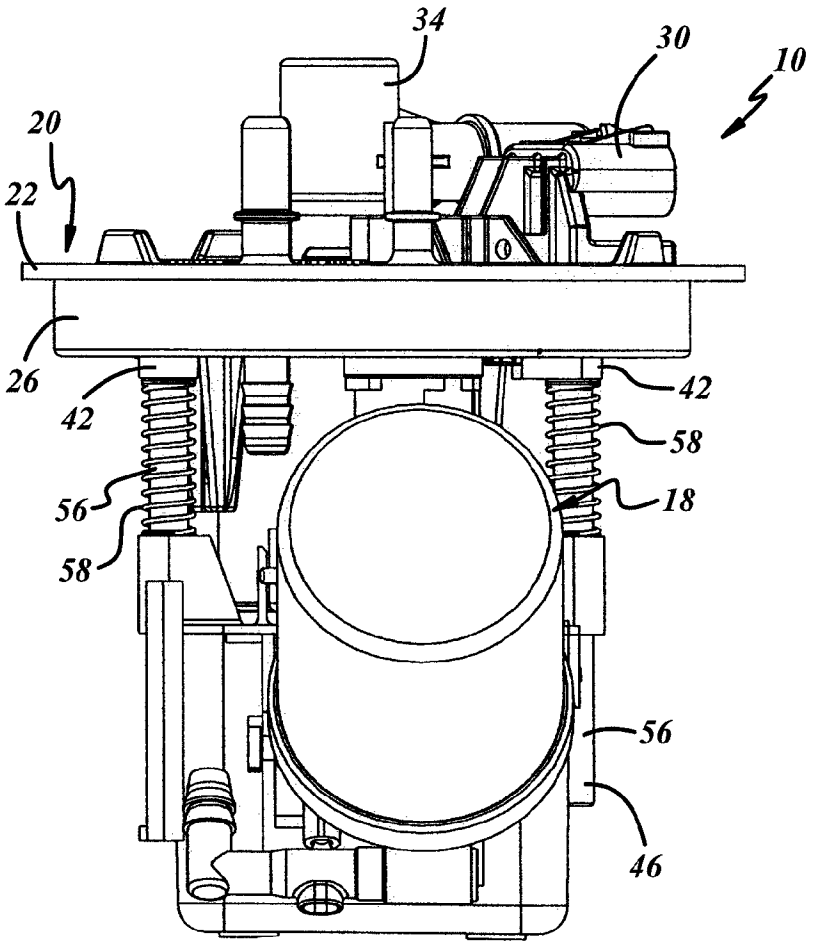
FIG. 4 is a side view of the fuel pump module.

As best shown in FIGS. 1, 3 and 5, a fuel pressure regulator 76 is preferably also carried by the reservoir 16, and may be mounted within a socket 78 (FIGS. 10 and 11) formed in the lid 48 of the reservoir 16. The fuel pressure regulator 76 includes an inlet that is communicated with the outlet of the fuel pump 12 as will be discussed in more detail, and an outlet that is communicated with the fuel outlet fitting of the mounting flange through a suitable conduit or hose (not shown). The regulator 76 is constructed and arranged in known manner to limit the maximum pressure of fuel discharged from the fuel pump module 10. As best shown in FIG. 5, the fuel pressure regulator includes a bypass outlet 80 through which fuel delivered to the fuel pressure regulator 76 at a pressure above the threshold pressure is discharged from the regulator 76 and into the interior of the reservoir 16, or into the fuel tank 12.

As best shown in FIGS. 3 and 6-10, the fuel filter assembly 18 preferably is mounted for pivoted or angular movement relative to the reservoir 16. The fuel filter assembly 18 preferably is laterally or radially spaced from the mounting flange 20 such that the mounting flange does not axially overlie any portion of the filter assembly 18 (axially as used in this sentence refers to an axis 81 of the generally circular mounting flange as shown in FIG. 3). As shown, the reservoir 16 is horizontally or laterally disposed in the fuel tank such that it is longer than it is high or deep. Further, the reservoir is connected to the mounting flange 20 generally adjacent one end of the reservoir and the fuel filter assembly 18 is connected to the opposite end of the reservoir 16. So, the filter assembly 18, in one presently preferred implementation, is laterally or radially offset from the mounting flange by a majority of the length of the reservoir 16. In this embodiment, a longitudinal axis 83 (FIG. 5) of the fuel pump 14 is generally parallel with the orientation or longitudinal extent of the reservoir l6 so that the fuel pump 14 is generally horizontally disposed when the module 10 is installed in a fuel tank.

The fuel filter assembly 18 includes a support 84, a pivot feature or mount 86 carried by the support 84, a secondary pump 88 carried by the support, a fuel filter housing 90 and a fuel filter 92 disposed within the fuel filter housing 90. The fuel filter housing is connected at a first end to the fuel reservoir 16, and has a second or free end spaced from the fuel reservoir. In at least one position of the fuel filter it is disposed at an angle to the axis 81 of the mounting flange so that the axial distance from the second end to the mounting flange is less than the axial distance from the mounting flange to the first end. This may define a generally U-shaped fuel supply module to facilitate inserting and mounting the module in a fuel tank having a relatively low profile or small open space adjacent to an opening through which the fuel supply module is inserted into the fuel tank.

Figure 9:
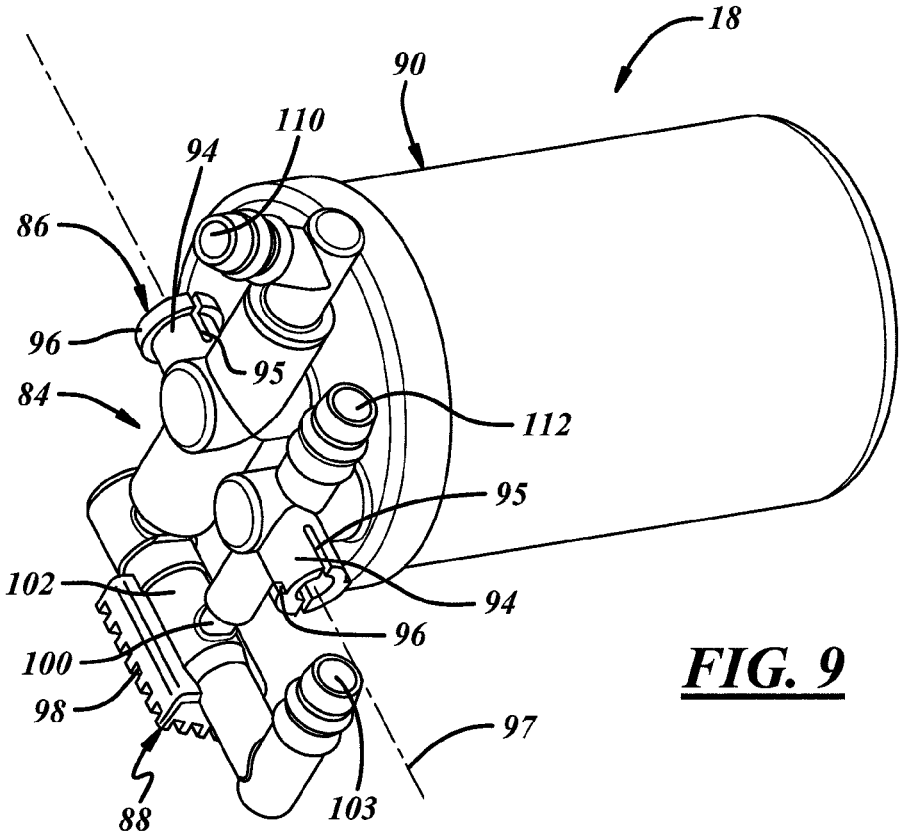
FIG. 9 is a perspective view of a filter assembly of the fuel pump module.
Figure 11:
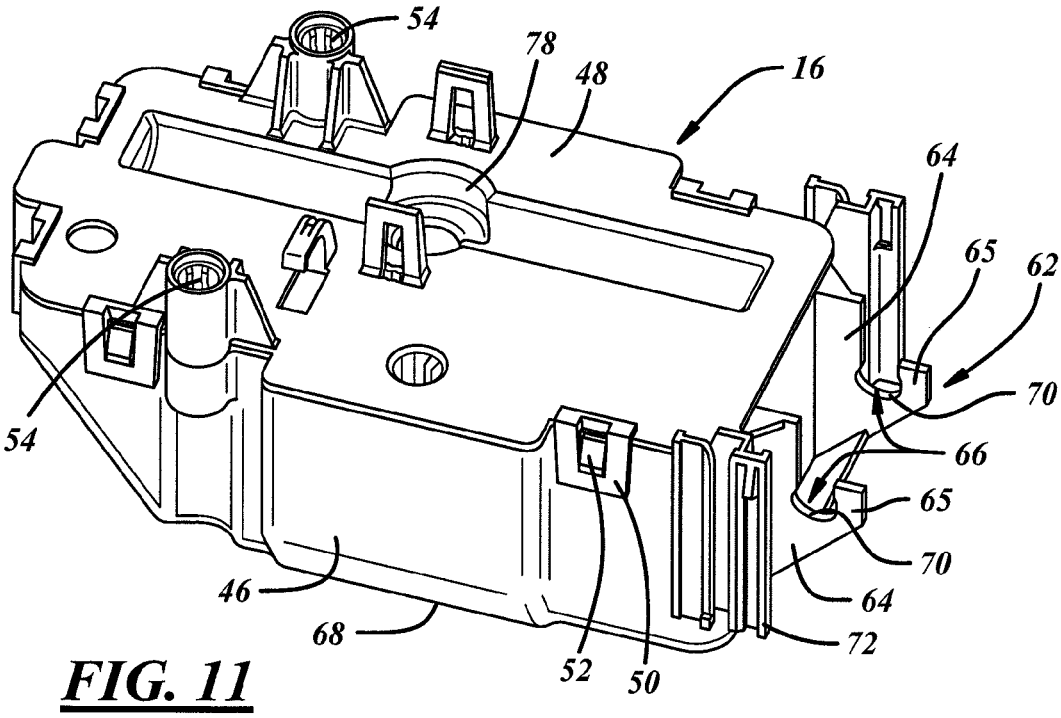
FIG. 11 is a perspective view of a reservoir of the fuel pump module.

As best shown in FIG. 9, the support 84 preferably is a polymeric structure to which at least a portion of the fuel filter housing 90 is connected at its first end of the fuel filter assembly. The pivot mount 86 preferably is integrally formed with the support 84 and has one or more cylindrical portions 94 each having an outer diameter sized for snap-fit receipt through the open area 66 and into the mounts 64 of the bracket 62 to connect the support 84 to the bracket 62. The cylindrical portions 94 may have slots 95 that more readily permit flexing of the cylindrical portions to facilitate their snap-fit receipt in the mounts 64. So connected, the support 84 can pivot about an axis 97 (FIG. 9) of the pivot mount 86 relative to the bracket 62 and reservoir 16. The cylindrical portions 94 may include enlarged heads 96 or shoulders constructed to be arranged outboard of the mounts 64 in assembly to prevent significant shifting of the support 84 along the axis of the pivot mount 86. The snap-fit retention may facilitate assembly, replacement, and service of the filter assembly.

As discussed further below, the support 84 may also include one or more fuel passages to facilitate communication between the high pressure fuel pump 14, the fuel filter assembly 18 and other components, as desired. Such other components may include, by way of examples without limitation, a fuel pressure regulator and the secondary pump 88. The fuel passages in the support may be molded in one piece with the cylindrical portions 94 and other structural features of the support 84.

Figure 7:
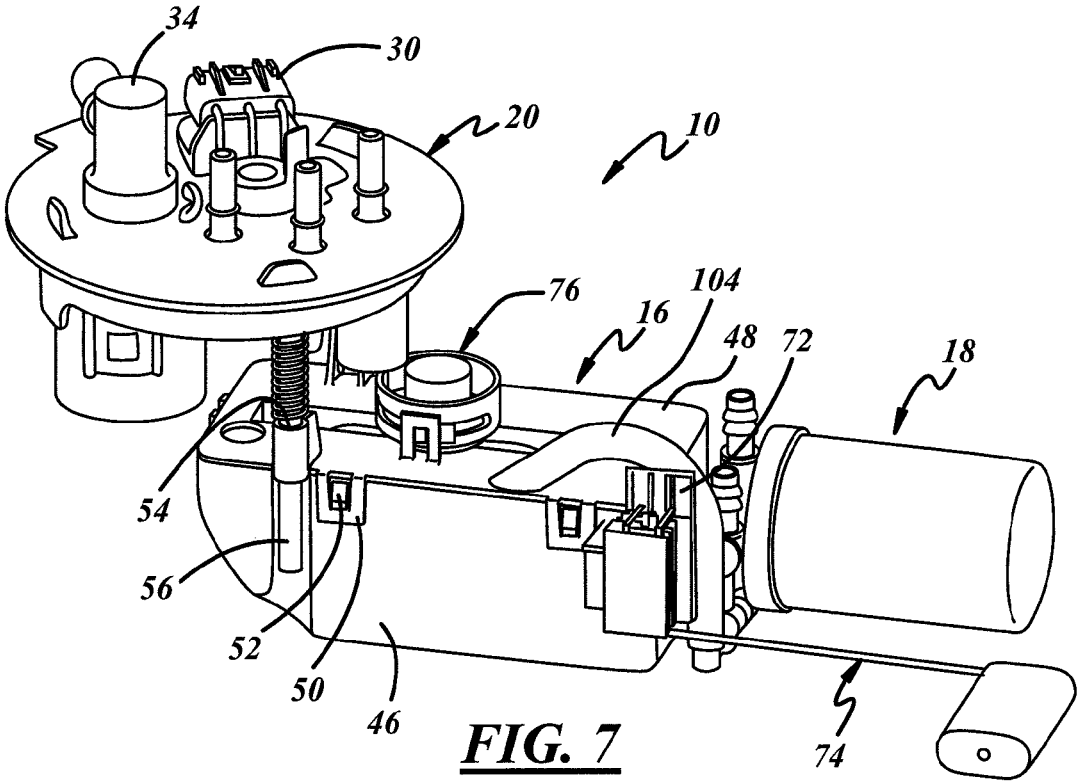
FIG. 7 is a perspective view of the fuel pump module showing a different angular orientation of a filter assembly.
Figure 8:
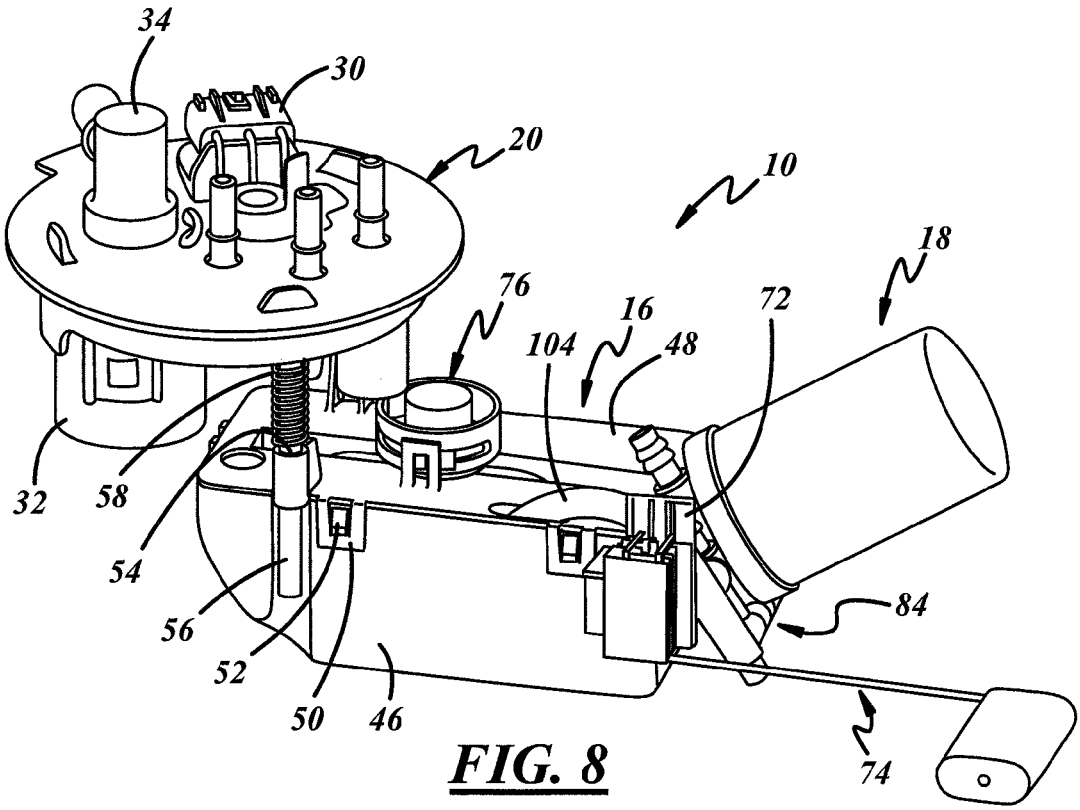
FIG. 8 is a perspective view of the fuel pump module.

The secondary pump 88 is carried by and preferably has portions formed integrally with the support. Accordingly, in this implementation, the secondary pump 88 is disposed laterally between the fuel reservoir 16 and the fuel filter assembly 18. The secondary pump 88 may be a jet pump having a various fuel passages, such as a low pressure inlet 98, a high pressure inlet 100 communicated with an outlet of the high pressure fuel pump 14, a nozzle (not shown) communicated with the high pressure inlet 100 and with a venturi tube 102 in the area of the low pressure inlet 98. The venturi tube 102 has an outlet end 103 that is communicated with the reservoir interior 53, such as by a flexible fluid conduit 104 (FIGS. 7 and 8). In operation, a portion of fuel that is pressurized by the fuel pump 14 is delivered through the high pressure inlet 100 and to the nozzle. The nozzle discharges fuel into the venturi tube 102 which creates an area of relatively low pressure in the region of the low pressure inlet 98 of the jet pump 88. The low pressure inlet 98 is open to the interior of the fuel tank and the low pressure created by the jet pump 88 causes fuel to flow from the fuel tank, into the low pressure inlet 98, and into the venturi tube 102 with the flow of fuel from the nozzle. The low pressure inlet 98 preferably is disposed adjacent to the bottom of the fuel tank to facilitate entraining fuel into the jet pump even during relatively low fuel level conditions in the fuel tank. Fuel flows through the venturi tube 102 and the fuel conduit 104 whereupon it is discharged into the reservoir 16. So the jet pump 88 moves fuel from the fuel tank to the reservoir 16 to provide a supply of fuel available to the inlet of the high pressure fuel pump 14. Since the jet pump 88 is driven by relatively high pressure fuel discharged from the fuel pump 14, it can be considered a "supply-side" jet pump arrangement, as is generally known in the art.

The support 84 preferably also includes a fuel outlet 110 that is communicated with the interior of the fuel filter housing 90 to receive filtered fuel from the housing 90, and a fuel inlet 112 that is communicated with the outlet of the fuel pump 14 and receives pressurized fuel discharged from the fuel pump 14. The fuel inlet 112 is preferably communicated with both the interior of the fuel filter housing 90 and the high pressure inlet 100 of the jet pump 88, such as by a "T" fitting or joint so that a portion of the fuel discharged from the fuel pump 14 flows to the jet pump 88 as previously described, and the rest of the fuel discharged from the fuel pump 14 flows into the fuel filter housing 90 so that it may be filtered. Of course, the fuel may be further split or divided and routed to other fuel system components, for example, another secondary pump.

Figure 10:
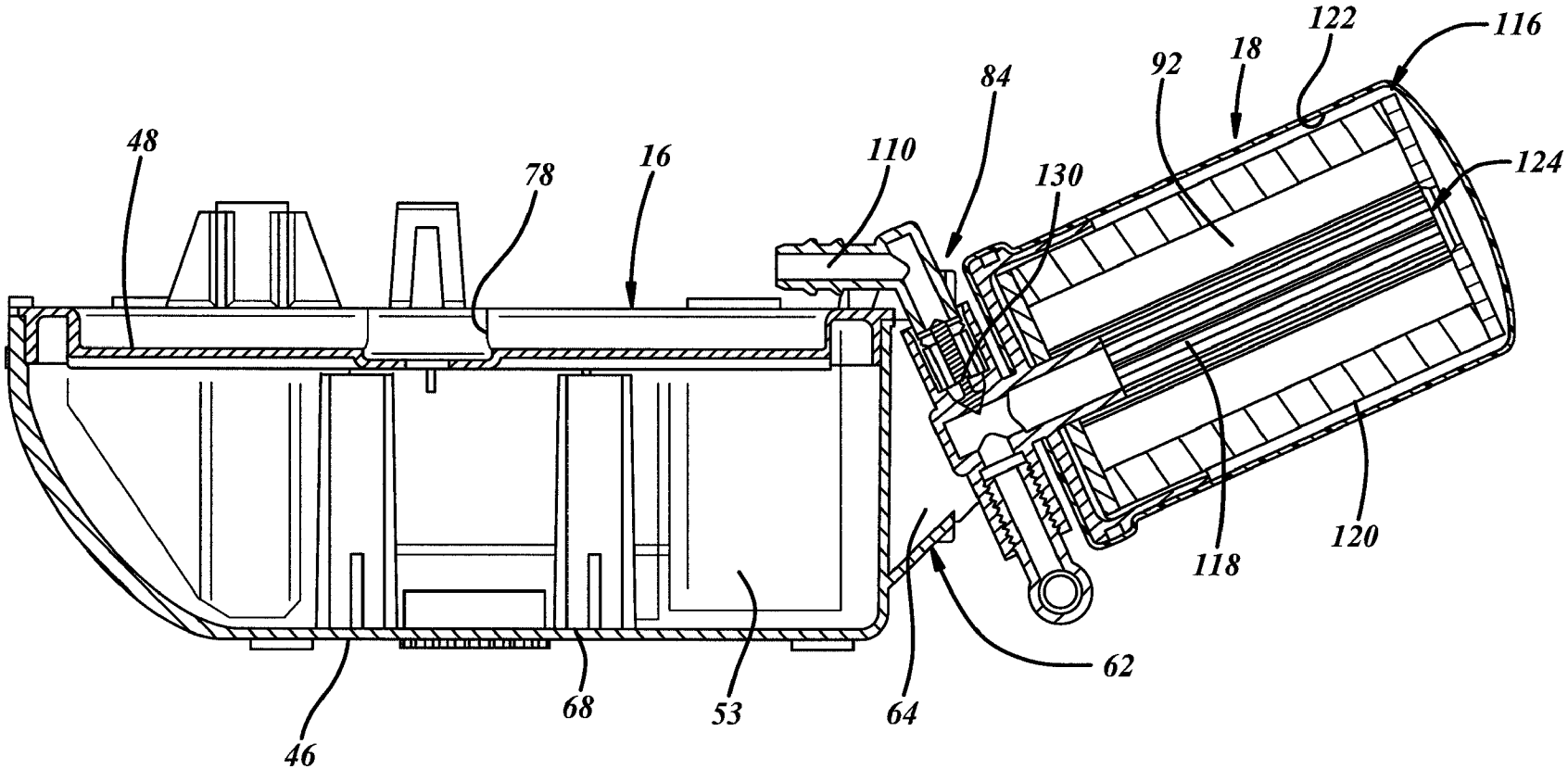
FIG. 10 is a side sectional view of a portion of the fuel pump module.

As best shown in FIG. 10, the fuel filter housing 90 includes a chamber 116 in which the fuel filter 92 is received. The fuel filter 92 is preferably a hollow or annular cylindrical body of filter material having an inner surface 118 and an outer surface 120, and a desired pore size and construction to permit fuel to flow therethrough, and to filter the fuel. With such a fuel filter construction, the inlet 112 may be communicated with either the interior or exterior of the fuel filter 92, and the outlet 110 may be communicated with the other of the interior and exterior of the fuel filter 92. In the embodiment shown, the inlet 112 is communicated with a chamber 122 defined about the outer surface 120 of the fuel filter and the outlet 110 is communicated with a chamber 124 defined in part by the inner surface 118 of the fuel filter 92. Accordingly, fuel that enters the fuel filter housing 90 through the inlet 112 must flow through the fuel filter 92 prior to exiting the housing 90 and the outlet 110.

The outlet 110 is communicated with an inlet (not shown) of the fuel pressure regulator 76 so that filtered and pressurized fuel is delivered to the fuel pressure regulator 76. Fuel discharged from the fuel pressure regulator is delivered to the fuel outlet fitting 36 of the mounting flange 20, by a tube, other conduit or molded passage(s), for example. As shown in FIG. 10, the outlet 110 preferably includes a check valve 130 to prevent the backflow of fuel from the pressure regulator 76 (or downstream thereof) back into the fuel filter housing 90, and to maintain the pressure of fuel downstream of the check valve 130.

Accordingly, a connection feature interconnects the fuel filter and the reservoir. The connection feature may include, for example, a mount (such as a pivot or fixed mount) or support carried by one or both of the fuel filter and the reservoir. The connection feature may include one or more fuel passages, such as those discussed with reference to the support 84, or other fuel passages as desired to route fuel in an around the fuel supply module 10.

In some fuel tanks, such as those that are relatively shallow in the area of the opening in which the fuel supply module 10 is to be installed, it may be necessary to pivot or otherwise move the filter assembly 18 relative to the reservoir 16 from a first position, such as shown in FIG. 7 to a second position as shown in FIG. 8. During this movement, the angle of an axis 140 (FIG. 1) of the filter assembly 18 relative to the orientation of the reservoir is changed. In one position, the axis 140 may be generally parallel to the orientation of the reservoir, and in another position, it may be inclined at an acute included angle relative thereto. This permits a reduction in a dimension of the module to facilitate insertion of the module into the fuel tank. In the implementation shown, movement of the filter relative to the reservoir permits a reduction in the overall height or length of the module 10 from the distal end of the filter assembly 18 to the mounting flange 20, and thereby facilitates angled insertion of the module 10 into the fuel tank.

The flexibility afforded by this module 10 permits larger components to be used with the fuel module to maximize the performance of the components and the module. For example, a larger fuel filter 92 can be used enabling use of a filter 92 that will last at least as long as the projected life of the module 10 (or a vehicle in which the module is used) so that the fuel filter 92 will not need to be replaced. Still further, a relatively large reservoir 16 can be used to improve at least the low fuel performance of the fuel module 10. After the module is assembled into the fuel tank 14, the filter assembly 18 may assume a different orientation than it was in during assembly. The in-tank position of the filter assembly 18 may be dictated by the fuel tank shape and size, or it may be determined by a biasing member, such as a spring, the yieldably biases the filter assembly 18 to a desired angular position.

Figure 12:
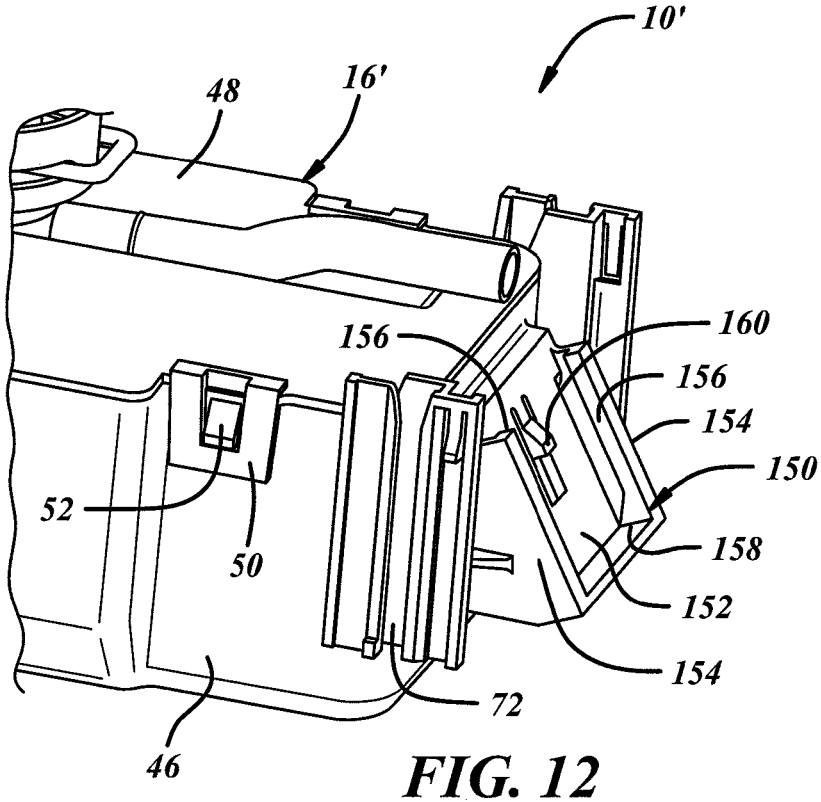
FIG. 12 is a fragmentary perspective view of a reservoir for an alternate embodiment of a fuel pump module.
Figure 13:
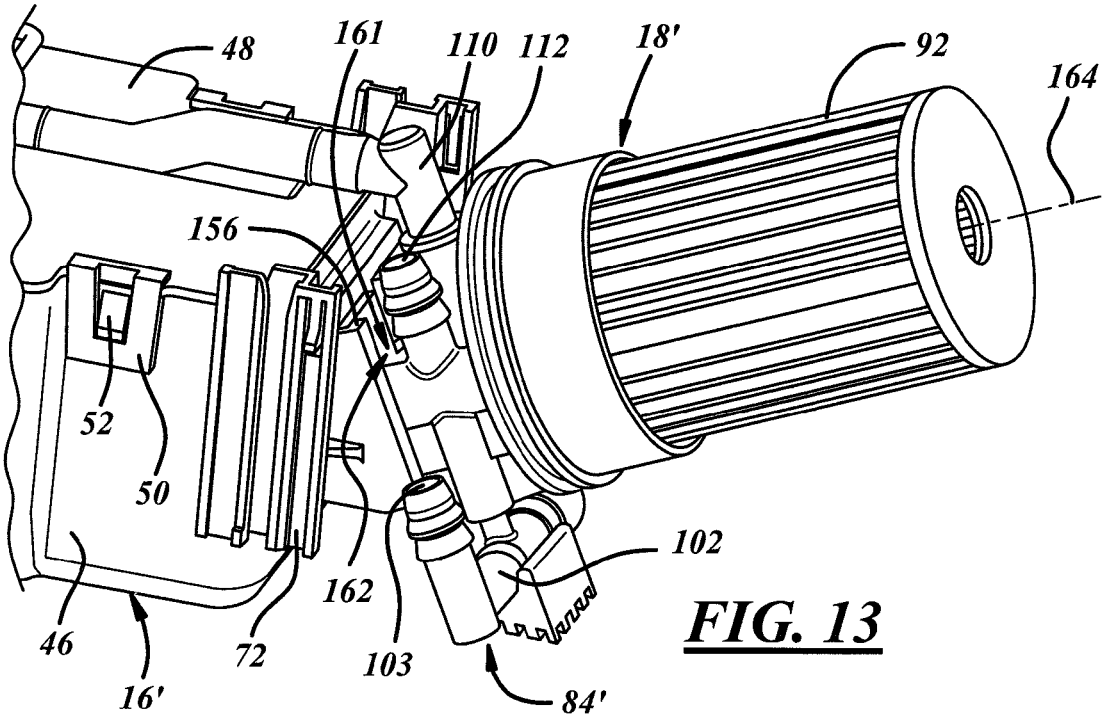
FIG. 13 is a fragmentary perspective view of a portion of the reservoir of FIG. 12 and a fuel filter assembly carried thereby.

In some fuel tank constructions, it may not be necessary to allow the filter assembly to pivot or move relative to the remainder of the assembly during installation into a fuel tank, or otherwise. FIGS. 12 and 13 illustrate portions of another embodiment of a fuel pump module 10' wherein a fuel filter assembly 18' is not angularly moveable relative to a reservoir 16' on which it is mounted. As best shown in FIG. 12, the reservoir 16' includes a mounting bracket or receptacle 150 having a sloped inner wall 152, upstanding side walls 154 with inwardly extending flanges 156 defining a recess 158, and a lock feature such as a tab 160 in the recess.

As best shown in FIG. 13, a modified support 84' includes a complementary mount 161 with outwardly extending projections 162 that may be slidably received in the receptacle 150 with a portion of the flanges 156 overlying a portion of the mount 161, and with a lock feature such as a snap latch disposed over and retained in position about the lock tab 160. So assembled, a longitudinal axis 164 of the filter assembly 18' is disposed at a fixed angle to the reservoir 16' due to or as a function of the angle of the inner wall 152 of the receptacle 150, and the filter assembly 18' does not pivot or angularly rotate relative to the reservoir 16'. The inner wall 152 may be disposed at any desired angle, including an angle that disposes the filter assembly 18' generally parallel to the reservoir 16' and/or bottom wall of the fuel tank (i.e. not inclined upwardly or downwardly relative to the reservoir). The fuel passages interconnecting the various fuel system components like the high pressure fuel pump 14, fuel filter assembly 18', pressure regulator, secondary pump, and the like, may be rigid, molded passages rather than flexible fuel lines which can facilitate assembly of the fuel supply module. Of course, flexible fuel lines can be used in combination with or in place of the molded passages, as desired. In at least some implementations, all or at least most of the fluid flowing parts and passages contained within the fuel filter assembly 18 and the mount connecting the fuel filter assembly to the reservoir 16 may be formed from non-conductive materials to prevent generation of static charges and improve electric static charge dissipation control.

Otherwise, the module 10' and its components may be constructed and arranged in substantially the same manner as in the fuel module 10. Some of the same reference numbers used in the description of the module 10 have been applied to portions of the module 10' for ease of comparison.

The disclosure of presently preferred embodiments set forth herein is in terms of description and not limitation. Those of ordinary skill in this art will readily recognize that other embodiments can be made, as well as various modifications to the embodiments disclosed, all of which may fall within the spirit and broad scope of this invention. By way of example without limitation, a jet pump driven by fuel returned to the fuel tank as is known in the art or a jet pump driven by fuel bypassed from the pressure regulator 76 may be used instead of the supply-side jet pump, if desired. Of course, other substitutions or modifications may be employed.

The invention claimed is:

1. A fuel supply module, comprising:

a mounting flange having an axis and a perimeter for mounting on a fuel tank;

a reservoir having an interior, carried by the flange and extending outwardly generally radially of the perimeter of the flange;

a fuel pump having an inlet in communication with the interior of the reservoir and an outlet through which fuel is discharged under pressure;

a fuel filter carried by the reservoir generally radially outboard of the perimeter of the flange and extending radially outwardly of the reservoir, and having an inlet communicated with the fuel pump outlet to filter fuel discharged from the fuel pump outlet and an outlet through which filtered fuel is discharged from the fuel filter; and a connection feature interconnecting the reservoir and the fuel filter and including a support and a first fuel passage formed in one piece with the connection feature, wherein the first fuel passage communicates fuel discharged from the fuel pump with the fuel filter.

2. The fuel supply module of claim 1 wherein the support includes a pivot feature that permits pivoted movement of the fuel filter relative to the reservoir.

3. The fuel supply module of claim 2 wherein the first fuel passage is formed in one piece with the support.

4. The fuel supply module of claim 1 wherein the first fuel passage is formed in one piece with the support.

5. The fuel supply module of claim 1 wherein the reservoir and fuel filter are disposed at an angle to the axis of the mounting flange.

6. The fuel supply module of claim 5 wherein the fuel filter is connected at a first end to the reservoir, has a second end spaced from the reservoir, and in at least one position of the fuel filter it is disposed at an angle to the axis so that the axial distance from the second end to the mounting flange is less than the axial distance from the first end to the mounting flange.

7. The fuel supply module of claim 6 wherein the fuel filter is disposed at an angle to the reservoir to provide a generally U-shaped module.

8. The fuel supply module of claim 1 wherein the connection feature includes the support that is coupled to the fuel filter and the mounting bracket coupled to the reservoir, and the support and mounting bracket define a trunnion connection between the fuel filter and reservoir.

9. The fuel supply module of claim 8 wherein one of the support or the mounting bracket includes a pivot mount having a cylindrical portion and the other of the support or the mounting bracket includes a trunnion mount, and the cylindrical portion is connected to the trunnion mount by a snap-fit.

10. A fuel supply module, comprising:

a reservoir having an interior;

a fuel pump having an inlet in communication with the interior of the reservoir and an outlet through which fuel is discharged under pressure;

a fuel filter carried by the reservoir and having an inlet communicated with the fuel pump outlet to filter fuel discharged from the fuel pump outlet and an outlet through which filtered fuel is discharged from the fuel filter;

a connection feature interconnecting the reservoir and the fuel filter and including a support and a first fuel passage formed in one piece with the connection feature, wherein the first fuel passage communicates fuel discharged from the fuel pump with the fuel filter; and a secondary pump carried on the support and having a low pressure inlet in communication with a supply of fuel and an outlet in communication with the interior of the reservoir to provide fuel to the reservoir.

11. The fuel supply module of claim 10 wherein the secondary fuel pump also includes a high pressure inlet in communication with the outlet of the fuel pump through the first fuel passage, a nozzle and a venturi tube downstream of the nozzle so that fuel received through the high pressure inlet is discharged from the nozzle and through the venturi tube to create an area of low pressure in the region of the low pressure inlet to cause fuel to flow into the low pressure inlet.

12. The fuel supply module of claim 10 wherein the secondary pump is disposed between the reservoir and fuel filter.

13. The fuel supply module of claim 1 wherein the support includes a mounting bracket carried by the reservoir and having a sloped inner wall, and a complementary mount connected to the mounting bracket to dispose the fuel filter at an angle to the reservoir as a function of the angle of the sloped inner wall.

14. The fuel supply module of claim 13 which also includes a lock feature carried by at least one of the mounting bracket and the mount to retain the fuel filter on the reservoir.

15. The fuel supply module of claim 10 wherein the first fuel passage communicates both the fuel filter and the secondary pump with the fuel pump.

16. A fuel supply module including a fuel outlet through which fuel is discharged from the module for delivery to an engine, comprising:

a reservoir having an interior;

a fuel pump having an inlet in communication with the interior of the reservoir and an outlet through which fuel is discharged under pressure;

a connection feature;

a fuel filter movably connected to the reservoir by the connection feature and disposed in the fuel flow path between the fuel pump and the fuel outlet of the module and arranged to filter fuel discharged from the fuel pump outlet before that fuel is discharged from the fuel outlet; and a secondary pump having a low pressure inlet in communication with a supply of fuel, a high pressure inlet in communication with the outlet of the fuel pump, an outlet in communication with the interior of the reservoir and a nozzle in communication with the high pressure inlet and a venturi tube downstream of the nozzle, and at least a portion of the secondary pump is carried on the connection feature and disposed between the high pressure inlet and the outlet to create an area of low pressure in the region of the low pressure inlet as fuel flows through the nozzle and venturi tube to supply fuel to the interior of the reservoir.

17. The fuel supply module of claim 16 wherein the high pressure inlet is formed in one piece with the support and communicates with an inlet of the fuel filter such that a portion of the fuel discharged from the fuel pump flows through the fuel filter and another portion of the fuel discharged from the fuel pump flows through the jet pump.

18. The fuel supply module of claim 16 wherein the fuel filter is movably carried by the reservoir to permit reduction in a dimension of the module to facilitate insertion of the module into a fuel tank.

19. A fuel supply module, comprising:

a mounting flange having an axis and a perimeter for mounting on a fuel tank;

a reservoir having an interior, carried by the flange and extending outwardly generally radially of the perimeter of the flange;

a fuel pump having an inlet in communication with the interior of the reservoir and an outlet through which fuel is discharged under pressure;

a fuel filter carried by the reservoir generally radially outboard of the perimeter of the flange and extending radially outwardly of the reservoir, and having an inlet communicated with the fuel pump outlet to filter fuel discharged from the fuel pump outlet and an outlet through which filtered fuel is discharged from the fuel filter;

a connection feature interconnecting the fuel filter and the reservoir and including a first fuel passage that communicates the fuel pump with the fuel filter; and a secondary pump carried by the connection feature and having an inlet in communication with the first fuel passage to receive fuel discharged from the fuel pump outlet and an outlet in communication with the interior of the reservoir to pump fuel to the reservoir.

20. The fuel supply module of claim 19 wherein the connection feature provides a snap-fit connection between the fuel filter and the reservoir.

21. The fuel supply module of claim 19 wherein the connection feature permits movement of the filter assembly relative to the reservoir.

22. The fuel supply module of claim 19 wherein the connection feature permits the fuel filter to be inclined relative to the reservoir to provide a generally U-shaped module in at least one position of the fuel filter.

23. A fuel supply module, comprising:

a mounting flange having an axis and a perimeter for mounting on a fuel tank;

a reservoir having an interior, carried by the flange and extending outwardly generally radially of the perimeter of the flange;

a fuel pump having an inlet in communication with the interior of the reservoir and an outlet through which fuel is discharged under pressure;

a fuel filter carried by the reservoir generally radially outboard of the perimeter of the flange and extending radially outwardly of the reservoir, and having an inlet communicated with the fuel pump outlet to filter fuel discharged from the fuel pump outlet and an outlet through which filtered fuel is discharged from the fuel filter; and a connection feature connecting together the reservoir and the fuel filter and including a bracket connected to one of the reservoir and the fuel filter, a support connected to the other of the reservoir and fuel filter and adapted to be connected to the bracket so that the fuel filter is carried by the reservoir, and a first fuel passage formed in one piece with the support, wherein the first fuel passage communicates the fuel pump with the fuel filter and the support includes a pivot mount formed in one piece with the first fuel passage to permit pivoted movement of the fuel filter relative to the reservoir.

24. The module of claim 23 wherein the support includes more than one fuel passage formed integrally therewith.

25. A fuel supply module to be mounted in a fuel tank, comprising:

a mounting flange having an axis and a perimeter radially outboard of the axis and constructed and arranged for mounting on a fuel tank;

a reservoir having an interior, carried by the flange for being received within the fuel tank and extending generally radially outwardly of the perimeter of the flange, and the reservoir extends laterally in the fuel tank with a length longer than its height;

a fuel pump having an inlet in communication with the interior of the reservoir and an outlet through which fuel is discharged under pressure;

a fuel filter outside of and carried by the reservoir and having an inlet communicating with the fuel pump outlet to filter fuel discharged from the fuel pump outlet and an outlet through which filtered fuel is discharged from the fuel filter; and a connector mounting the fuel filter on the reservoir radially outboard of the perimeter of the flange with the filter having an axis inclined to the axis of the flange and the filter extending generally radially outwardly of the reservoir.

* * * * *